US010328492B2

(12) United States Patent
Kaneta et al.

(10) Patent No.: US 10,328,492 B2
(45) Date of Patent: Jun. 25, 2019

(54) METAL POWDER PRODUCTION APPARATUS

(71) Applicant: Seiko Epson Corporation, Tokyo (JP)

(72) Inventors: Yuki Kaneta, Hachinohe (JP); Toshiki Akazawa, Hachinohe (JP)

(73) Assignee: Seiko Epson Corporation (JP)

( * ) Notice: Subject to any disclaimer, the term of this patent is extended or adjusted under 35 U.S.C. 154(b) by 204 days.

(21) Appl. No.: 15/424,147

(22) Filed: Feb. 3, 2017

(65) Prior Publication Data

US 2017/0239731 A1 Aug. 24, 2017

(30) Foreign Application Priority Data

Feb. 19, 2016 (JP) ..... 2016-030403
Feb. 19, 2016 (JP) ..... 2016-030404

(51) Int. Cl.
*B22F 9/08* (2006.01)

(52) U.S. Cl.
CPC ..... *B22F 9/082* (2013.01); *B22F 2009/086* (2013.01); *B22F 2009/0884* (2013.01); *B22F 2009/0888* (2013.01); *B22F 2009/0892* (2013.01)

(58) Field of Classification Search
CPC ..... B22F 9/082
See application file for complete search history.

(56) References Cited

U.S. PATENT DOCUMENTS 5,482,532 A * 1/1996 Isshiki ..... B22F 9/082 264/12
2017/0239731 A1* 8/2017 Kaneta ..... B22F 9/082

FOREIGN PATENT DOCUMENTS

JP 2001-064703 A 3/2001
JP 2009-275269 A 11/2009
JP 2010-090411 A 4/2010

* cited by examiner

*Primary Examiner* — Scott R Kastler
(74) *Attorney, Agent, or Firm* — Harness, Dickey & Pierce, P.L.C.

(57) ABSTRACT

A metal powder production apparatus includes a molten metal supply section which supplies a molten metal, a cylindrical body which includes an upper part placed on a lower side of the molten metal supply section and a lower part provided on a lower side of the upper part, a fluid jet section which jets a gas (fluid) toward the molten metal, and a cooling liquid outflow section which allows a cooling liquid to flow out along the inner circumferential surface of the upper part. In the metal powder production apparatus, an angle formed by the axial line of the upper part of the cylindrical body and the vertical line is 0° or more and 20° or less, and an angle formed by the axial line of the lower part of the cylindrical body and the vertical line is 0° or more and 20° or less.

12 Claims, 9 Drawing Sheets

METAL POWDER PRODUCTION APPARATUS

CROSS-REFERENCE TO RELATED APPLICATIONS

This application claims priority to Japanese Patent Application No. 2016-030403 filed on Feb. 19, 2016 and No. 2016-030404 filed on Feb. 19, 2016. The entire disclosures of Japanese Patent Applications No. 2016-030403 and No. 2016-030404 are hereby incorporated herein by reference.

BACKGROUND

1. Technical Field

The present invention relates to a metal powder production apparatus.

2. Related Art

There has been known a method for producing a metal powder using a so-called water atomization method (for example, see JP-A-2001-64703 (Patent Document 1)).

In the method for producing a metal powder described in Patent Document 1, a water atomization method is used as a liquid spraying method in which a liquid stream is sprayed on molten metal particles. In the water atomization method, a cooling speed after spraying is fast, and therefore, a molten metal is solidified before it is spheroidized by surface tension. Therefore, the obtained powder is likely to have an irregular shape.

With respect to such a problem, the invention described in Patent Document 1 has tried to solve the problem by adding a step of allowing a formed powder to pass through a region heated to a temperature equal to or higher than the melting point of the constituent metal of the powder to spheroidize the powder. The region heated to a temperature equal to or higher than the melting point refers to a plasma region or a combustion gas region.

However, in the method described in Patent Document 1, it is necessary to provide a plasma region or a combustion gas region, and therefore, an increase in the size of the apparatus or an increase in the cost cannot be avoided. Further, in this method, the metal powder once solidified is melted again, and therefore, an unintended change in the composition or crystal structure may be caused. In addition, for example, in the case where an amorphous metal powder is produced, unintended crystallization may be caused.

SUMMARY

An advantage of some aspects of the invention is to provide a metal powder production apparatus capable of producing a metal powder in which an unintended change in the property is small and also sufficient spheroidization is achieved.

The advantage can be achieved by the following configuration.

A metal powder production apparatus according to an aspect of the invention includes a molten metal supply section which supplies a molten metal, a cylindrical body which includes an upper part placed on a lower side of the molten metal supply section and a lower part provided on a lower side of the upper part, a fluid jet section which jets a fluid toward the molten metal supplied from the molten metal supply section so as to allow the fluid to collide with the molten metal in the upper part or on an upper side of the upper part, and a cooling liquid outflow section which allows a cooling liquid to flow out along the inner circumferential surface of the upper part of the cylindrical body, wherein an angle formed by the axial line of the upper part of the cylindrical body and the vertical line is 0° or more and 20° or less, and an angle formed by the axial line of the lower part of the cylindrical body and the vertical line is 0° or more and 20° or less, and the minimum inner diameter of the lower part of the cylindrical body is 15% or more and 85% or less of the inner diameter of the upper part.

According to this configuration, a metal powder production apparatus capable of producing a metal powder in which an unintended change in the property is small and also sufficient spheroidization is achieved is obtained.

In the metal powder production apparatus according to the aspect of the invention, it is preferred that the cylindrical body includes a portion whose inner diameter continues to decrease downward.

According to this configuration, the diameter of the swirling flow of the cooling liquid flowing in the lower part can be gradually decreased without inhibiting the flow of the cooling liquid, and therefore, a moderate cooling liquid layer can be formed, and also air in a boundary part between the upper part and the lower part can be more strongly compressed. As a result, even in the case where the total length of the cylindrical body is decreased, a fall time sufficient for a droplet which falls is ensured, and thus, sufficient spheroidization is achieved.

In the metal powder production apparatus according to the aspect of the invention, it is preferred that the length of the upper part in the vertical direction is 1 time or more and 7 times or less of the inner diameter of the upper part.

According to this configuration, the length of the upper part is optimized, and therefore, a necessary and sufficient flying distance by the free fall of a droplet can be ensured, and an unintended change in the property is suppressed and sufficient spheroidization is achieved. Further, an unintended change in the composition or crystallization can be prevented by preventing the flying time from being excessively long. As a result, a metal powder in which an unintended change in the composition or structure is small and also sufficient spheroidization is achieved can be efficiently produced.

In the metal powder production apparatus according to the aspect of the invention, it is preferred that the length of the lower part in the vertical direction is 2 times or more of the inner diameter of the upper part.

According to this configuration, the length of the lower part is optimized, and therefore, the flow of the cooling liquid can be moderately delayed in the lower part. Due to this, in the boundary part between the upper part and the lower part, the air pressure can be continuously increased. As a result, a metal powder in which sufficient spheroidization is achieved can be efficiently produced.

In the metal powder production apparatus according to the aspect of the invention, it is preferred that the fluid is an inert gas.

According to this configuration, the molten metal can be cut into pieces by the fluid having a relatively small heat capacity, and therefore, while achieving powdering, oxidation of the metal during the powdering can be suppressed. As a result, while suppressing oxidation or significant deformation of a droplet, the molten metal can be cut into pieces, and thus, a metal powder in which an unintended change in the composition is further reduced and also sufficient spheroidization is achieved can be produced.

In the metal powder production apparatus according to the aspect of the invention, it is preferred that a space which is provided inside the upper part and is surrounded by a cooling liquid layer constituted by the cooling liquid on the lateral side and the lower side is included.

According to this configuration, a space which is hermetically sealed except for the upper side is formed, and therefore, when the air pressure in the space is increased, the air pressure is hardly decreased, so that it becomes easy to maintain the air pressure constant. As a result, a metal powder having a small variation in the composition, crystallinity, and sphericity can be easily produced.

A metal powder production apparatus according to an aspect of the invention includes a molten metal supply section which supplies a molten metal, a cylindrical body which is a cylindrical body placed on a lower side of the molten metal supply section and includes a portion in which a spiral groove is formed on the inner circumferential surface of the cylindrical body, a fluid jet section which jets a fluid toward the molten metal supplied from the molten metal supply section, and a cooling liquid outflow section which allows a cooling liquid to flow out along the inner circumferential surface of the portion of the cylindrical body, wherein an angle formed by the axial line of the portion of the cylindrical body and the vertical line is 0° or more and 20° or less, and the groove and the cooling liquid outflow section are configured such that the rotation direction of an arbitrary object when the object is allowed to move by gravity along the spiral groove and a state where the object moves is viewed from the vertically upper side, and the rotation direction of the cooling liquid when a state where the cooling liquid is allowed to flow out along the inner wall surface of the portion of the cylindrical body is viewed from the vertically upper side are the same as each other.

According to this configuration, a metal powder production apparatus capable of producing a metal powder in which an unintended change in the composition is small and also sufficient spheroidization is achieved is obtained.

In the metal powder production apparatus according to the aspect of the invention, it is preferred that an angle formed by a plane orthogonal to the axis of the cylindrical body and the groove is equal to an angle formed by the plane and the outflow direction of the cooling liquid.

According to this configuration, the groove and the flow of the cooling liquid match each other, and thus, the occurrence of turbulence in the cooling liquid can be minimized. As a result, the cooling liquid layer can be further stabilized.

In the metal powder production apparatus according to the aspect of the invention, it is preferred that the width of the groove is 0.01% or more and 1% or less of the inner diameter of the portion of the cylindrical body.

According to this configuration, the width of the groove is optimized according to the circumferential speed of the cooling liquid layer. As a result, the cooling liquid layer can be particularly stabilized.

In the metal powder production apparatus according to the aspect of the invention, it is preferred that the depth of the groove is 10% or more and 500% or less of the width of the groove.

According to this configuration, the depth of the groove is optimized according to the circumferential speed of the cooling liquid layer. As a result, the cooling liquid layer can be particularly stabilized.

In the metal powder production apparatus according to the aspect of the invention, it is preferred that the transverse cross-sectional shape of the groove is a triangle or a semicircle.

According to this configuration, the ease of replacement of the cooling liquid in the groove can be increased. Therefore, the uniformity of the quality of the metal powder can be further increased.

In the metal powder production apparatus according to the aspect of the invention, it is preferred that the fluid is an inert gas.

According to this configuration, the molten metal can be cut into pieces by the fluid having a relatively small heat capacity, and therefore, while achieving powdering, oxidation of the metal during the powdering can be suppressed. As a result, while suppressing oxidation or significant deformation of a droplet, the molten metal can be cut into pieces, and thus, a metal powder in which an unintended change in the composition is further reduced and also sufficient spheroidization is achieved can be produced.

In the metal powder production apparatus according to the aspect of the invention, it is preferred that the cylindrical body includes an upper part composed of the portion and a lower part provided continuous with the lower end of the upper part, and the lower part is inclined with respect to the upper part so that an angle formed by the axial line of the lower part and the vertical line is larger than an angle formed by the axial line of the upper part and the vertical line.

According to this configuration, the axial line becomes discontinuous in a connection part between the upper part and the lower part, and therefore, the flowing-down speed of the cooling liquid decreases in the connection part between the upper part and the lower part after the cooling liquid supplied to the upper part flows down along the inner circumferential surface of the upper part. As a result, the cooling liquid continues to be in a state of being retained in the connection part between the upper part and the lower part. Therefore, in the internal space of the cylindrical body, the cooling liquid layer having a sufficient thickness is formed also on the bottom surface as well as on the side surface. Then, the droplet of the molten metal can go into the cooling liquid having a sufficient volume with a high probability, and thus, an unintended change in the property is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a metal powder production apparatus according to the invention will be described in detail based on preferred embodiments shown in the accompanying drawings.

First Embodiment

Figure 1:
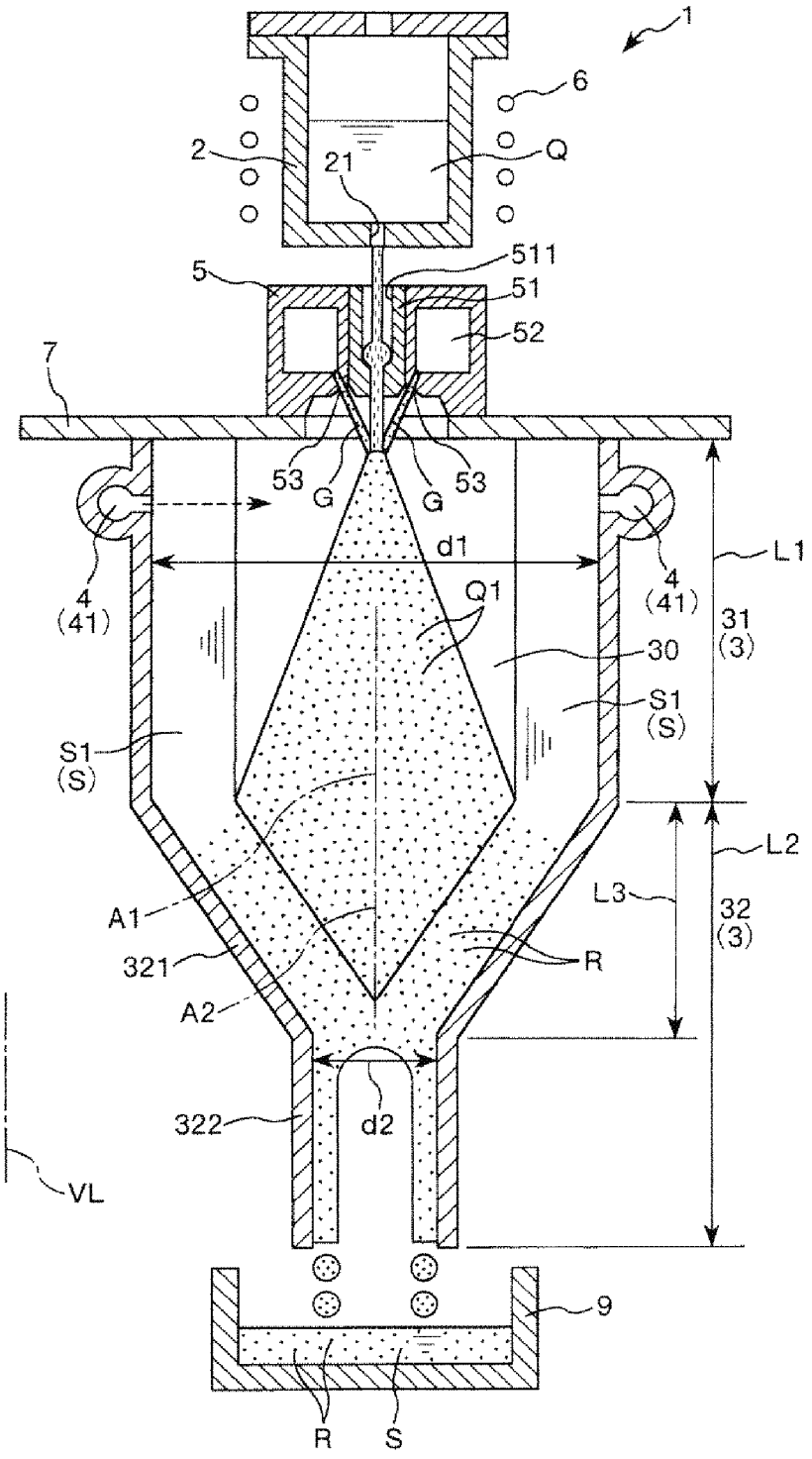
FIG. 1 is a schematic view (vertical cross-sectional view) showing a first embodiment of the metal powder production apparatus according to the invention.

FIG. 1 is a schematic view (vertical cross-sectional view) showing a first embodiment of the metal powder production apparatus according to the invention. In the following description, in the drawing, the upper side is referred to as "upper", and the lower side is referred to as "lower".

A metal powder production apparatus 1 shown in FIG. 1 is an apparatus for obtaining a metal powder R by powdering a molten metal Q by an atomization method, followed by cooling and solidification. This metal powder production apparatus 1 includes a molten metal supply section 2 (tundish) which supplies the molten metal Q, a cylindrical body 3 (cooling vessel) provided on the lower side of the molten metal supply section 2, a cooling liquid outflow section 4 which allows a cooling liquid S to flow out into the cylindrical body 3, and a fluid jet section 5 (nozzle) which jets a gas G (fluid) toward the molten metal Q which flows down. Hereinafter, the configurations of the respective sections will be described.

As shown in FIG. 1, the molten metal supply section 2 includes a portion having a bottomed cylindrical shape. In this molten metal supply section 2, the molten metal Q obtained by melting a raw material of a metal powder to be produced is temporarily stored. Such a molten metal supply section 2 is constituted by, for example, a fireproof material such as graphite or silicon nitride. Further, on the outer periphery of the molten metal supply section 2, an induction coil 6 for keeping the molten metal Q warm by heating is provided.

The molten metal Q may contain any element, and, for example, a metal containing at least one of Ti and Al can be used. These elements have a high activity, and therefore, in the case where the molten metal Q contains either of these elements, even if the time for which the metal is in contact with air is short, the metal is easily oxidized, and therefore, it becomes difficult to pulverize the metal. On the other hand, by using the metal powder production apparatus 1, even if the molten metal Q contains such an element, the metal can be easily powdered, and therefore, a metal powder R in which an unintended change in the composition is small and also sufficient spheroidization is achieved can be produced.

Further, an ejection port 21 is provided in the center of the bottom part of the molten metal supply section 2. From this ejection port 21, the molten metal Q in the molten metal supply section 2 is ejected downward by free fall.

On the lower side of such a molten metal supply section 2, the cylindrical body 3 including an internal space 30 is provided.

The cylindrical body 3 has a cylindrical shape. The length of the axial line of the cylindrical body 3 is longer than the maximum inner diameter of the cylindrical body 3. Therefore, the cylindrical body 3 has a cylindrical shape which is long and thin in the vertical direction.

In the internal space 30 of this cylindrical body 3, as described later, many droplets Q1 formed by cutting (scattering) the molten metal Q into pieces by the gas G from the fluid jet section 5 are supplied, and also a cooling liquid layer S1 is formed by the cooling liquid S supplied from the cooling liquid outflow section 4. When the droplet Q1 comes into contact with the cooling liquid layer S1, the droplet Q1 is cooled and solidified. The thus produced metal powder R is collected in a collection tank 9 along with the cooling liquid S.

The shape of the cross section on the inner diameter side when the cylindrical body 3 is cut in a direction orthogonal to the axial line thereof is set to be, for example, a circle such as a perfect circle, an ellipse, or an elongated circle, but is preferably a perfect circle.

On the upper side (in the vicinity of an upper end part) of such a cylindrical body 3, an annular lid member 7 is provided. On this lid member 7, the fluid jet section 5 is provided such that the gas G can be jetted into the internal space 30 of the cylindrical body 3 through an opening in a central part of the lid member 7.

Further, in the vicinity of the upper end part of the cylindrical body 3, the cooling liquid outflow section 4 is provided along the circumferential direction thereof. The cooling liquid outflow section 4 is constituted by a plurality of (in FIG. 1, two) cooling liquid outflow ports 41 provided side by side at substantially equal intervals along the circumferential direction of the lid member 7.

Each cooling liquid outflow port 41 can swirl the cooling liquid S in the circumferential direction of the cylindrical body 3 by allowing the cooling liquid S to flow out in the direction of the tangent line of the inner circumferential surface of the cylindrical body 3. In this manner, the cooling liquid S forms the cooling liquid layer S1 on the inner wall surface of the cylindrical body 3.

By configuring each cooling liquid outflow port 41 as described above, the flow of the cooling liquid S in the cylindrical body 3 can be stabilized. As a result, the cooling liquid layer S1 having a sufficient thickness can be formed in the cylindrical body 3, and the droplet Q1 coming into contact with the cooling liquid layer S1 can be efficiently cooled. In addition, by bringing the droplet Q1 into contact with the cooling liquid layer S1 which always moves (swirls), the cooling ability by the cooling liquid S is increased. As a result, the cooling speed of the droplet Q1 can be further increased.

The outflow direction of the cooling liquid S which flows out from the cooling liquid outflow port 41 is not limited to the direction of the tangent line of the inner circumferential surface of the cylindrical body 3, and may be a direction (vertical direction) parallel to the vertical line, or may be a direction inclined with respect to both of the tangent line direction and the vertical direction. In addition, the number of cooling liquid outflow ports 41 to be placed is not particularly limited, and may be 3 or more.

As the cooling liquid S, water, an oil, or the like is used, and according to need, an additive such as a reducing agent may be added thereto.

Although not shown in the drawing, each cooling liquid outflow port 41 is connected to a cooling liquid tank through a cooling liquid supply pipe, and a pump is provided in the middle of the cooling liquid supply pipe. According to this, by operating the pump, the cooling liquid S in the cooling liquid tank can be supplied to each cooling liquid outflow port 41 through the cooling liquid supply pipe, and the pressurized cooling liquid S can be allowed to flow out (jetted) from each cooling liquid outflow port 41.

On the upper side of the cooling liquid outflow section 4, the fluid jet section 5 (gas jet nozzle) is provided.

As the fluid to be jetted from the fluid jet section 5, a gas or a liquid can be used. Examples of the gas include inert gasses such as nitrogen gas and argon gas, reducing gasses such as ammonia decomposed gas, and air. Examples of the liquid include water and mixed liquids in which an additive is added to water.

Among these, as the fluid, it is preferred to use a gas, and particularly, it is more preferred to use an inert gas. According to this, the molten metal Q can be cut into pieces by the fluid having a relatively small heat capacity, and therefore, while moderately suppressing the cooling speed as compared with the case where a liquid is used as the fluid, powdering can be achieved, and also oxidation of the metal during the powdering can be suppressed. As a result, while suppressing oxidation or significant deformation of the droplet Q1, the molten metal Q can be cut into pieces, and therefore, a metal powder in which an unintended change in the composition or structure (a change in the property) is further reduced and also sufficient spheroidization is achieved can be produced.

As shown in FIG. 1, the fluid jet section 5 includes a melt nozzle 51 provided on the same axis as that of the ejection port 21 of the molten metal supply section 2, a gas chamber 52 provided along the outer circumference of the melt nozzle 51, and a plurality of fluid jet ports 53 communicating with the gas chamber 52.

The melt nozzle 51 includes a melt nozzle hole 511 formed so as to penetrate along the vertical direction. Further, the melt nozzle 51 is constituted by a fireproof material.

Such a melt nozzle 51 once receives the molten metal Q flowing down from the ejection port 21 of the molten metal supply section 2 described above, and thereafter allows the molten metal Q to flow down in the cylindrical body 3 through the melt nozzle hole 511. The transverse cross-sectional shape and transverse cross-sectional area of the molten metal Q passing through the melt nozzle hole 511 become a shape and an area corresponding to the transverse cross-sectional shape and transverse cross-sectional area of the melt nozzle hole 511.

On the outer circumferential side of such a melt nozzle 51, the gas chamber 52 having an annular shape is provided along the circumferential direction thereof. To this gas chamber 52, the high-pressure gas G is supplied through a gas supply pipe (not shown) from the outside.

On the lower side of the gas chamber 52, the plurality of fluid jet ports 53 provided side by side along the circumferential direction thereof are provided. Each fluid jet port 53 communicates with the above-mentioned gas chamber 52 and is configured to jet the gas G.

As will be described in detail later, the plurality of fluid jet ports 53 according to this embodiment are provided on the same circumference around the axial line of the melt nozzle 51. Each of such a plurality of fluid jet ports 53 is configured to jet the gas G toward substantially the same position on the axial line of the melt nozzle 51 on the lower side thereof.

The molten metal Q flowing down from the melt nozzle hole 511 of the melt nozzle 51 collides with the gas G at a position where a plurality of streams of the gas G are concentrated (converged), and is cut into a plurality of droplets Q1. The plurality of droplets Q1 fall and collide with the cooling liquid layer S1, and thus, are further cut and pulverized, and also cooled and solidified, whereby a metal powder R (an aggregate of a plurality of metal particles) is obtained.

In this embodiment, the cylindrical body 3 includes an upper part 31 located on the lower side of the lid member 7 and a lower part 32 provided continuous with the lower end of the upper part 31.

Among these, the upper part 31 is configured such that the axial line A1 thereof is along the vertical direction. More specifically, the upper part 31 is disposed such that an angle formed by the axial line A1 and the vertical line VL is 0° or more and 20° or less. Incidentally, FIG. 1 shows the metal powder production apparatus 1 in which the angle formed by the axial line A1 and the vertical line VL is 0° as one example.

The axial line A1 as used herein refers to a straight line including the axis of the upper part 31 having a cylindrical shape, and the vertical line VL refers to a straight line showing the direction of gravity.

The lower part 32 is configured such that the axial line A2 thereof is along the vertical direction. More specifically, the lower part 32 is disposed such that an angle formed by the axial line A2 and the vertical line VL is 0° or more and 20° or less. Incidentally, FIG. 1 shows the metal powder production apparatus 1 in which the angle formed by the axial line A2 and the vertical line VL is 0° as one example. The axial line A2 as used herein refers to a straight line including the axis of the lower part 32.

The minimum inner diameter d2 of the lower part 32 is set to 15% or more and 85% or less of the inner diameter d1 of the upper part 31.

According to the metal powder production apparatus 1 provided with the cylindrical body 3 including the upper part 31 and the lower part 32 as described above, a metal powder R in which an unintended change in the composition is small and also sufficient spheroidization is achieved can be produced.

That is, by setting the angle formed by the axial line A1 of the upper part 31 and the vertical line VL within the above range, a relatively long flying distance of the droplet Q1 can be ensured. This means that when the angle formed by the axial line A1 and the vertical line VL is within the above range, the upper part 31 is disposed in a state where the axial line A1 is close to parallel to the vertical direction. In such a state, the flying direction due to the free fall of the droplet Q1 is substantially parallel to the axial line A1, and therefore, a sufficient flying distance along the up-and-down direction of the cylindrical body 3 can be ensured. In other words, in the inner circumferential surface of the cylindrical body 3, on the side surface, the cooling liquid layer S1 is formed, and therefore, the flying distance in the horizontal direction becomes shorter by that amount. On the other hand, in the up-and-down direction of the cylindrical body 3, the shape which is long and thin in the vertical direction can be utilized to the maximum, and therefore, a sufficient flying distance is ensured. As a result, the droplet Q1 flies a sufficiently long flying distance, and thus, a sufficiently long flying time is ensured. Due to this, during flying, spheroidization of the droplet Q1 by surface tension sufficiently proceeds, and a metal powder R in which sufficient spheroidization is achieved is finally obtained.

The angle formed by the axial line A1 and the vertical line VL is set to 0° or more and 20° or less, but is preferably set to 0° or more and 10° or less. When the angle formed by the axial line A1 and the vertical line VL exceeds the above upper limit, the axial line A1 is in a state of being relatively largely inclined with respect to the vertical line VL. Due to this, when considering the way of spreading of the molten metal Q at the time of colliding with the gas G and scattering, there is a fear that the possibility that many of the droplets Q1 go into the cooling liquid layer S1 formed on the side surface in the inner wall of the upper part 31 increases. As a result, a sufficiently long flying distance cannot be ensured, and spheroidization of the droplets Q1 becomes insufficient, and therefore, there is a fear that spheroidization of the metal powder R to be finally obtained becomes insufficient.

The minimum inner diameter d2 of the lower part 32 is set to 15% or more and 85% or less of the inner diameter d1 of the upper part 31, but is preferably set to 25% or more and 80% or less of the inner diameter d1, more preferably set to 35% or more and 75% or less of the inner diameter d1. According to this, the inner diameter decreases in the boundary part between the upper part 31 and the lower part 32, and therefore, when the cooling liquid S is concentrated in the boundary part, the internal air in the vicinity of the boundary part is easily compressed. Due to this, in the internal space 30 of the cylindrical body 3, in the vicinity of the boundary part between the upper part 31 and the lower part 32, air pressure increases. As a result, the flying speed (falling speed) of the droplet Q1 which falls in the vicinity decreases, and thus, a longer flying time of the droplet Q1 can be ensured. Therefore, a metal powder R in which further spheroidization is achieved is finally obtained.

In addition, by increasing the air pressure in the internal space 30, a compression force is also applied to the flying droplet Q1. The droplet Q1 to which this force is applied is deformed so that the surface area thereof is minimized. That is, the droplet Q1 is deformed so that the shape thereof is close to a perfect sphere. Also from this point of view, spheroidization of the metal powder R is achieved.

The air pressure in the internal space 30 during the production of the metal powder R is preferably 101% or more, more preferably 110% or more and 500% or less of the atmospheric pressure at the maximum. According to this, the effect as described above becomes more prominent.

The inner diameter d1 is not particularly limited, but is set to preferably about 5 cm or more and 200 cm or less, more preferably about 10 cm or more and 100 cm or less.

When the minimum inner diameter d2 of the lower part 32 is lower than the above lower limit, the minimum inner diameter d2 of the lower part 32 is too small, and therefore, the amount of the cooling liquid S which can pass through the lower part 32 in a unit time decreases. Due to this, the efficiency of production of the metal powder R decreases, and also the amount of the cooling liquid S to be allowed to flow out from the cooling liquid outflow ports 41 has to be limited, and thus, the cooling speed of the droplet Q1 decreases, and also the increase in the air pressure in the internal space 30 is limited. As a result, there is a fear that the cooling or spheroidization of the droplet Q1 is insufficient. In addition, if the amount of the cooling liquid S is not limited, a large amount of the cooling liquid S is retained in the upper part 31, and therefore, there is a fear that the metal powder cannot be produced.

On the other hand, when the minimum inner diameter d2 of the lower part 32 exceeds the above upper limit, the inner diameter d2 of the lower part 32 is too large, and therefore, the amount of the cooling liquid S which can pass through the lower part 32 in a unit time increases and also air easily escapes. Due to this, air in the internal space 30 is hardly compressed, and the flying speed (falling speed) of the droplet Q1 which falls hardly decreases. As a result, there is a fear that the spheroidization of the droplet Q1 is insufficient. In addition, when the amount of the cooling liquid S which can pass through the lower part 32 in a unit time increases, such a cooling liquid layer S1 that covers the internal space of the lower part 32 is hardly formed on the upper side of the lower part 32, and therefore, there is a fear that the cooling speed of the droplet Q1 decreases.

By setting the minimum inner diameter d2 of the lower part 32 within the above range as described above, such a cooling liquid layer S1 that covers the internal space of the lower part 32 is easily formed on the upper side of the lower part 32. Due to this, in the internal space 30 of the cylindrical body 3, a space which is surrounded by the cooling liquid layer S1 on the lateral side and the lower side is formed, and thus, practically almost all the droplets Q1 can be brought into contact with the cooling liquid layer S1. As a result, a metal powder R having a small variation in the cooling speed, and therefore, having a uniform quality is obtained.

The angle formed by the axial line A2 and the vertical line VL is set to 0° or more and 20° or less, but is preferably set to 0° or more and 10° or less. When the angle formed by the axial line A2 and the vertical line VL exceeds the above upper limit, the cooling liquid layer S1 is likely to be discontinuous, and air in the internal space 30 easily escapes through the lower part 32, and therefore, the air pressure in the internal space 30 is hardly increased. Due to this, there is a fear that the cooling or spheroidization of the droplet Q1 is insufficient.

The metal powder production apparatus 1 as described above exhibits an effect that a metal powder R in which an unintended change in the composition or structure is small and also sufficient spheroidization is achieved can be produced.

The inner diameter of the upper part 31 may change along the vertical direction, but may be constant as shown in FIG. 1. In the latter case, a space having a sufficient size can be formed inside the upper part 31, and also the cooling liquid layer S1 having a small variation in the thickness is easily formed on the inner wall of the upper part 31. As a result, a metal powder R in which sufficient spheroidization is achieved and also the quality is uniform is finally obtained.

In the case where the inner diameter changes, the inner diameter d1 denotes the inner diameter at the lower end of the upper part 31. The inner diameter of the upper part 31 is preferably 0.9 times or more and 1.1 times or less of the inner diameter d1. According to this, the same effect as described above is obtained.

On the other hand, the inner diameter of the lower part 32 may be constant along the vertical direction, but preferably includes a portion whose inner diameter gradually decreases in the vertically downward direction. According to this, the diameter of the swirling flow of the cooling liquid S flowing in the lower part 32 can be gradually decreased without inhibiting the flow of the cooling liquid S, and therefore, a moderate cooling liquid layer S1 can be formed, and also air in the boundary part between the upper part 31 and the lower part 32 can be more strongly compressed. As a result, even in the case where the total length of the cylindrical body 3 is decreased, a fall time sufficient for the droplet Q1 which falls is ensured, and thus, sufficient spheroidization is achieved.

A portion 321 (see FIG. 1) in which the inner diameter of the lower part 32 gradually decreases may occupy the entire lower part 32, however, the length L3 thereof is preferably 10% or more and 90% or less, more preferably 20% or more and 80% or less of the length L2 of the lower part 32. According to this, the decreasing ratio of the inner diameter in the portion 321 is optimized, and the cooling liquid layer S1 is less likely to be discontinuous. Due to this, both of the formation of the moderate cooling liquid layer S1 and the increase in the air pressure in the internal space 30 by ensuring the flow rate of the cooling liquid S can be achieved. As a result, a metal powder R in which an unintended change in the composition or structure is small and also sufficient spheroidization is achieved can be produced.

In the case where the lower part 32 includes the portion 321 in which the inner diameter gradually decreases, it is preferred that the inner diameter of the rest of the part is constant. The inner diameter of the portion 322 (see FIG. 1) in which the inner diameter is constant is preferably 15% or more and 85% or less, more preferably 20% or more and 80% or less, further more preferably 25% or more and 75% or less of the inner diameter d1 of the upper part 31. According to this, air particularly hardly escapes from the lower part 32, and therefore, air in the internal space 30 is more easily compressed, and thus, the flying speed of the droplet Q1 which falls can be further decreased.

The length L1 of the upper part 31 in the vertical direction is not particularly limited, but is preferably 1 time or more and 7 times or less, more preferably 1.5 times or more and 5 times or less, further more preferably 2 times or more and 4 times or less of the inner diameter d1 of the upper part 31. According to this, the length L1 of the upper part 31 is optimized, and therefore, a necessary and sufficient flying distance by the free fall of the droplet Q1 can be ensured, and an unintended change in the property is suppressed and sufficient spheroidization is achieved. Further, an unintended change in the composition or crystallization can be prevented by preventing the flying time from being excessively long. As a result, a metal powder R in which an unintended change in the composition or structure is small and also sufficient spheroidization is achieved can be efficiently produced.

The length L2 of the lower part 32 in the vertical direction is not particularly limited, but is preferably 2 times or more, more preferably 3 times or more and 10 times or less of the inner diameter d1 of the upper part 31. According to this, the length L2 of the lower part 32 is optimized, and therefore, the flow of the cooling liquid S can be moderately delayed in the lower part 32. Due to this, in the boundary part between the upper part 31 and the lower part 32, the air pressure can be continuously increased. As a result, a metal powder R in which sufficient spheroidization is achieved can be efficiently produced.

When the length L2 is lower than the above lower limit, the increase in the air pressure is likely to be intermittent, and there is a fear that spheroidization is insufficient. On the other hand, when the length L2 exceeds the above upper limit, although there is no problem in the spheroidization, however, there is a fear that the production efficiency of the metal powder R is decreased.

The angle formed by the axial line A1 of the upper part 31 and the axial line A2 of the lower part 32 is preferably 10° or less, more preferably 5° or less. According to this, the cooling liquid layer S1 is substantially continuously formed between the upper part 31 and the lower part 32. According to this, the air pressure in the internal space 30 is more easily increased. As a result, further spheroidization of the droplet Q1 can be achieved. In addition, the droplet Q1 can be evenly cooled, and an unintended change in the composition or structure of the droplet Q1 is suppressed. That is, for example, the variation in the composition such as oxidation amount (oxygen content) or crystallinity can be minimized.

Further, in the inside of the upper part 31 shown in FIG. 1, the cooling liquid layer S1 is formed on each of the side surface (lateral side) and the bottom surface (lower side). That is, when the cooling liquid layer S1 is formed on the upper side of the lower part 32, the internal space of the lower part 32 can be covered with the cooling liquid layer S1, and in the internal space 30 of the cylindrical body 3, a space surrounded by the cooling liquid layer S1 except for the upper side is easily formed. It can be said that such an internal space 30 is a space which is hermetically sealed except for the upper side. Therefore, when the air pressure in the internal space 30 is increased, the air pressure is hardly decreased, so that it becomes easy to maintain the air pressure constant. As a result, a metal powder R having a small variation in the composition, crystallinity, and sphericity can be easily produced.

Figure 2:
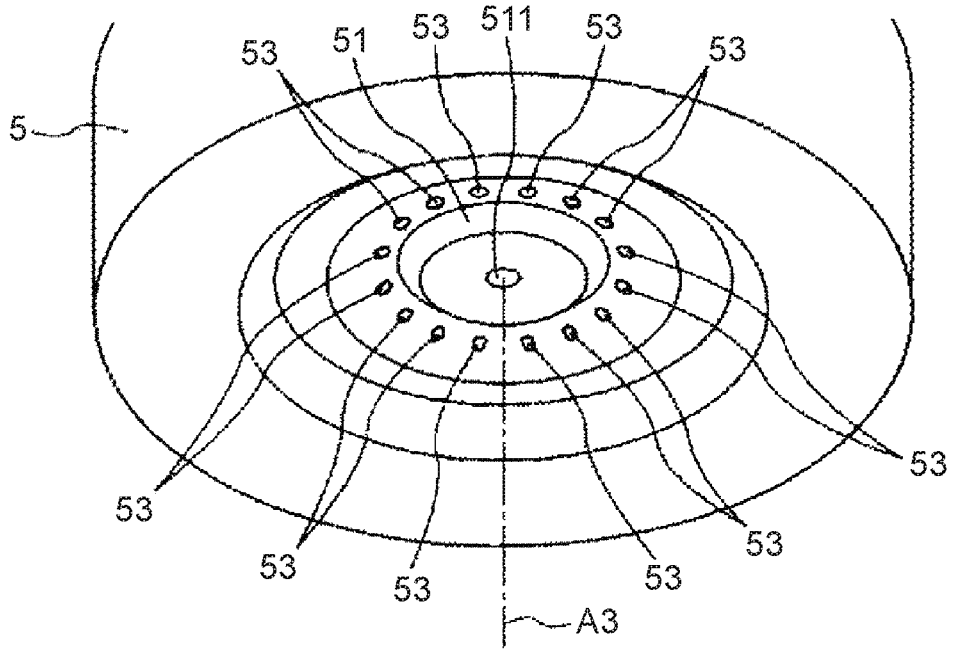
FIG. 2 is an enlarged perspective view of the vicinity of fluid jet ports in the metal powder production apparatus shown in FIG. 1.

FIG. 2 is an enlarged perspective view of the vicinity of the fluid jet ports 53 in the metal powder production apparatus 1 shown in FIG. 1.

As described above, in this embodiment, the plurality of fluid jet ports 53 are provided on the same circumference around the axial line A3 of the melt nozzle 51 (see FIG. 2). In addition, the areas of the openings of the fluid jet ports 53 may be different from one another, but are the same as one another in this embodiment. The respective fluid jet ports 53 communicate with the same gas chamber 52, and therefore, the gas G is jetted from each of the fluid jet ports 53 according to this embodiment at the same flow rate and the same flow amount. The streams of the gas G jetted from the respective fluid jet ports 53 are converged at the same position located on the axial line A3 of the melt nozzle 51. Therefore, the gas G spreads in a conical shape having the same axial line as the axial line A3 of the melt nozzle 51.

When the molten metal Q collides with the gas G at the position where the streams of the gas G are converged under such circumstances, the formed droplet Q1 spreads in a conical shape along with the gas G.

On the other hand, as described above, the angle formed by the axial line A1 of the upper part 31 of the cylindrical body 3 and the vertical line VL falls within a relatively small angle range. Therefore, when the droplet Q1 spreading in a conical shape along with the gas G falls freely, a moderate flying distance (flying time) is ensured by utilizing the shape of the internal space 30. As a result, many of the droplets Q1 can be sufficiently spheroidized.

The configuration of the fluid jet ports 53 is not limited to the configuration shown in FIG. 2.

Figure 3:
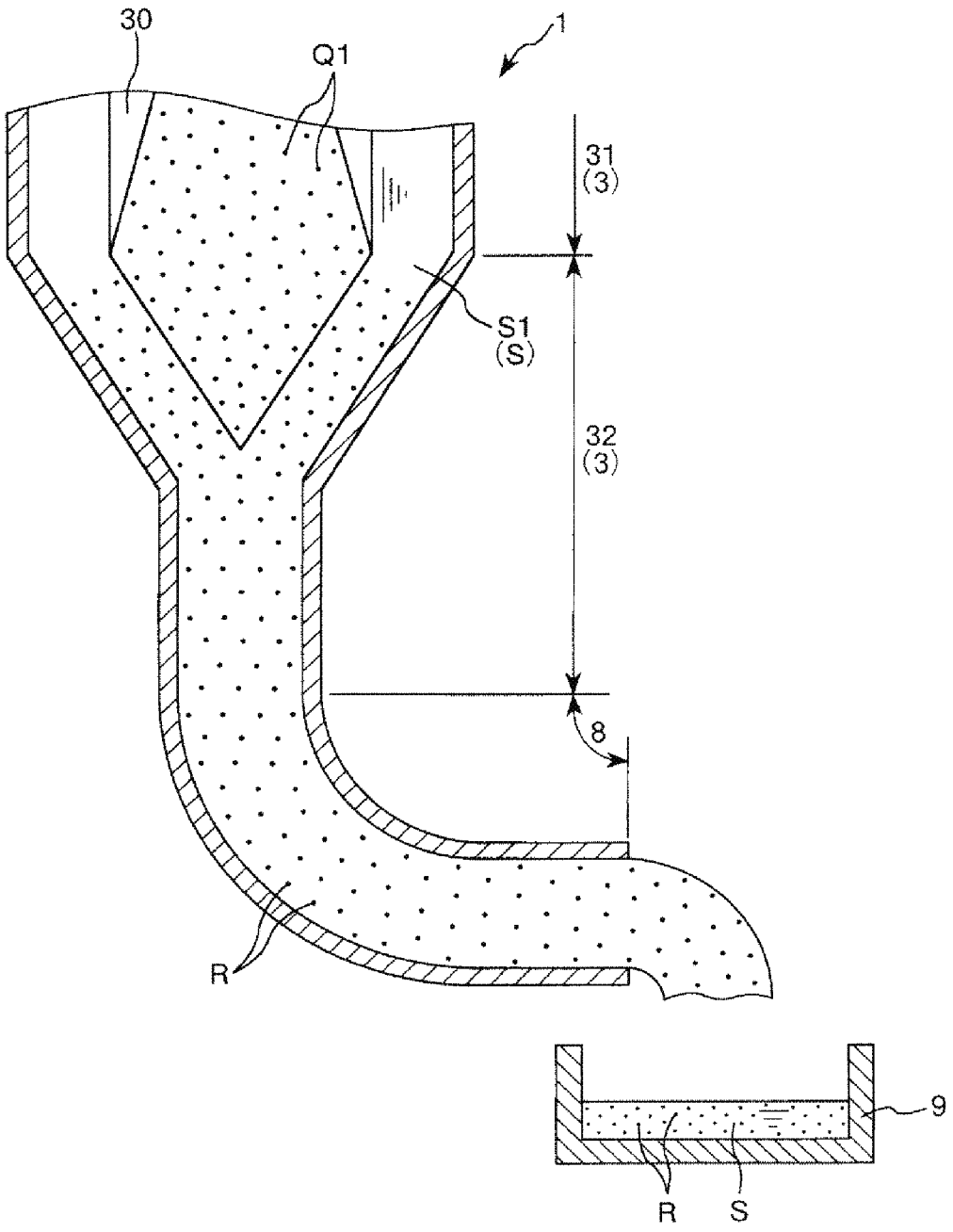
FIG. 3 is a vertical cross-sectional view showing a modification of the metal powder production apparatus shown in FIG. 1.

FIG. 3 is a vertical cross-sectional view showing a modification of the metal powder production apparatus shown in FIG. 1. In FIG. 3, the configuration of the apparatus is shown with some parts omitted.

In the metal powder production apparatus 1 shown in FIG. 3, a discharge pipe 8 for discharging the metal powder R along with the cooling liquid S is connected to the lower part 32 on the downstream side thereof, that is, on the opposite side to the upper part 31. This discharge pipe 8 is connected to the collection tank 9.

Then, a mixture of the metal powder R and the cooling liquid S collected in the collection tank 9 is subjected to a liquid removal device or the like, whereby the metal powder R can be separated. The separated metal powder R is dried by a dryer or the like.

According to the metal powder production apparatus 1 as described above, a metal powder R in which an unintended change in the composition is small and also sufficient spheroidization is achieved can be obtained.

Second Embodiment

Figure 4:
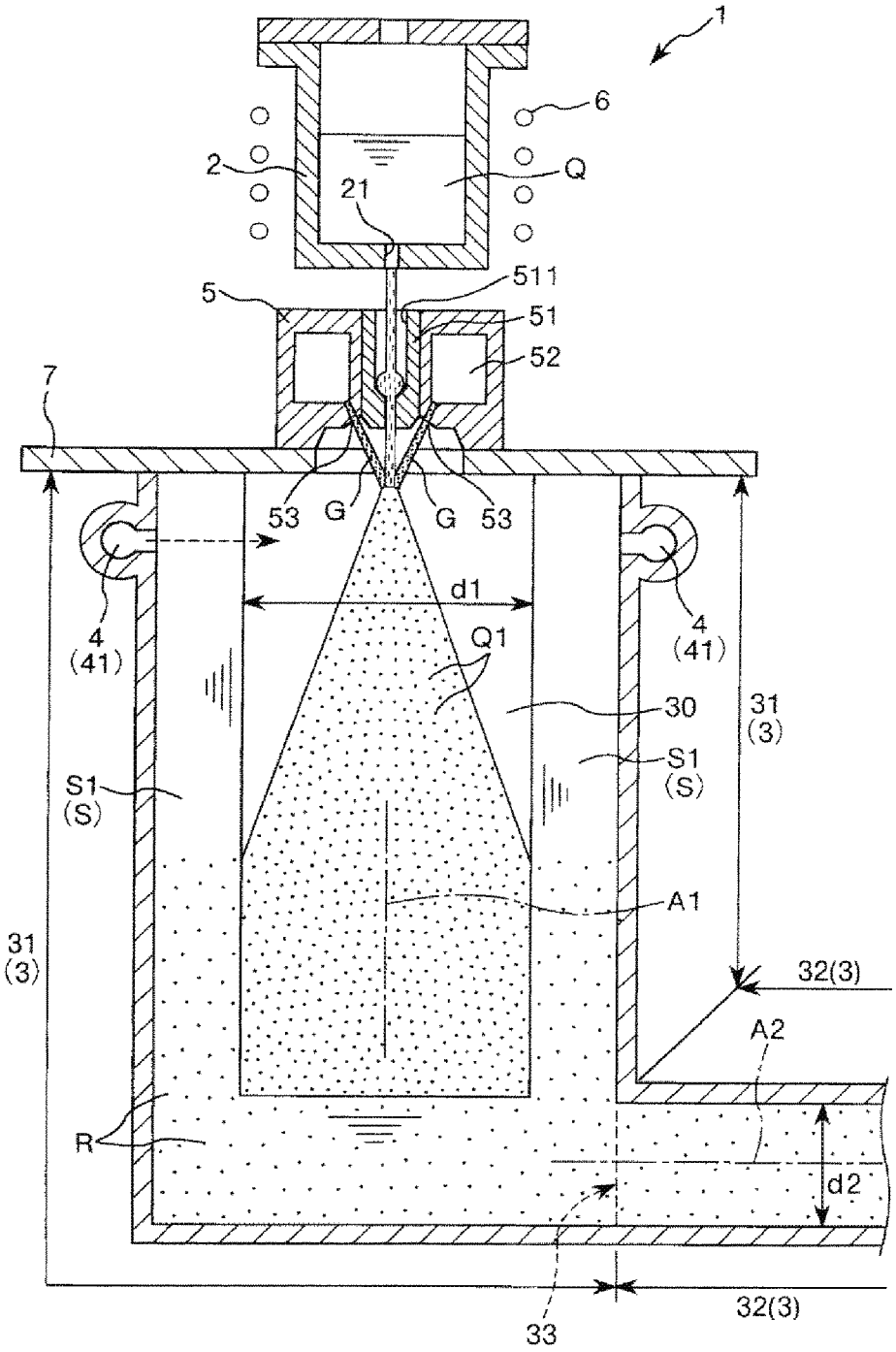
FIG. 4 is a schematic view (vertical cross-sectional view) showing a second embodiment of the metal powder production apparatus according to the invention.
Figure 5:
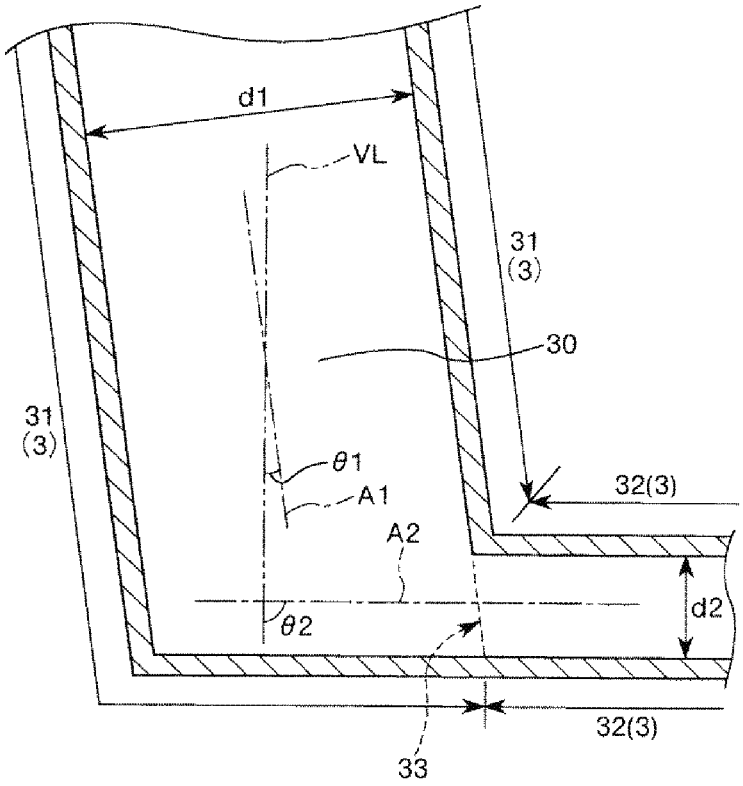
FIG. 5 is a schematic view (vertical cross-sectional view) showing another example of the second embodiment of the metal powder production apparatus according to the invention.

FIG. 4 is a schematic view (vertical cross-sectional view) showing a second embodiment of the metal powder production apparatus according to the invention. Further, FIG. 5 is a schematic view (vertical cross-sectional view) showing another example of the second embodiment of the metal powder production apparatus according to the invention. In FIG. 5, the configuration of the apparatus is shown with some parts simplified.

Hereinafter, the second embodiment of the metal powder production apparatus will be described, however, different points from the above-mentioned embodiment will be mainly described and the description of the same matter will be omitted.

A metal powder production apparatus 1 of this embodiment is the same as the above-mentioned metal powder production apparatus 1 of the first embodiment except that the configuration of the cylindrical body 3 is different.

The cylindrical body 3 of this embodiment includes an upper part 31 located on the lower side of a lid member 7 and a lower part 32 provided continuous with the lower end of the upper part 31 in the same manner as the cylindrical body 3 of the metal powder production apparatus 1 of the first embodiment. The upper part 31 and the lower part 32 are continuous with each other through a connection part 33, and according to this, the cylindrical body 3 in which the axis is bent in the middle is formed as a whole. The upper part 31 and the lower part 32 each have a cylindrical shape. The connection part 33 as used herein refers to the boundary surface between the upper part 31 and the lower part 32.

Among these, the upper part 31 is configured such that the axial line A1 thereof is along the vertical direction. More specifically, the upper part 31 is disposed such that the angle formed by the axial line A1 and the vertical line VL is 0° or more and 20° or less. Incidentally, FIG. 4 shows the metal powder production apparatus 1 in which the angle formed by the axial line A1 and the vertical line VL is 0° as one example.

Further, FIG. 5 shows the metal powder production apparatus 1 in which the angle θ1 formed by the axial line A1 and the vertical line VL exceeds 0° (but 20° or less) as another example. That is, the metal powder production apparatus 1 shown in FIG. 5 is the same as the metal powder production apparatus 1 shown in FIG. 4 except that the angle θ1 is different.

Incidentally, in the following description, the angle formed by the axial line A1 and the vertical line VL is also referred to as "the inclination angle of the axial line A1".

Figure 6:
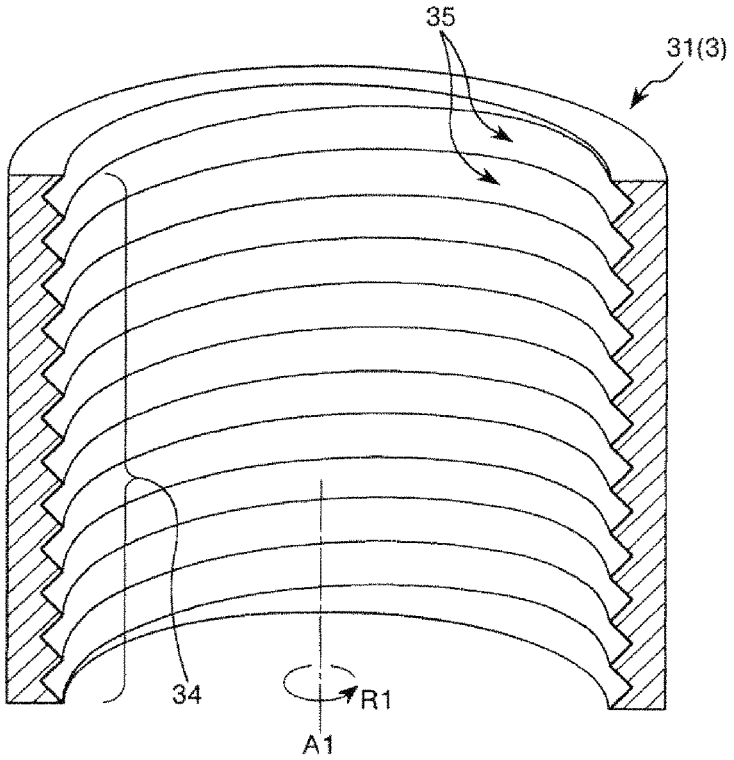
FIG. 6 is an enlarged partial cross-sectional view of a portion of the cylindrical body shown in FIG. 4.

FIG. 6 is an enlarged partial cross-sectional view of a portion of the cylindrical body 3 shown in FIG. 4.

The cylindrical body 3 includes a spiral groove 35 formed on the inner circumferential surface 34 of the upper part 31. The spiral groove 35 is formed so that the spiral axis thereof and the axis of the upper part 31 of the cylindrical body 3 match each other. Therefore, in the case shown in FIG. 4, the angle formed by the spiral axis and the vertical line is equal to the above-mentioned angle θ1 and is 0° or more and 20° or less.

Further, in the example shown in FIG. 6, the transverse cross-sectional shape of the groove 35 is a triangle, and the adjacent grooves 35 are in contact with each other.

Here, the configuration of the spiral groove 35 is associated with the configuration of the above-mentioned cooling liquid outflow section 4.

More specifically, when assuming that an arbitrary object is allowed to move in the vertically downward direction along the groove 35 by gravity, the rotation direction of the object when a state where the object moves is viewed from the vertically upper side is referred to as "the rotation direction of the groove 35". On the other hand, the rotation direction of the cooling liquid S when a state where the cooling liquid S is allowed to flow out from the cooling liquid outflow section 4 is viewed from the vertically upper side is referred to as "the rotation direction of the cooling liquid S". In this embodiment, the groove 35 and the cooling liquid outflow section 4 are configured respectively such that the rotation direction of the groove 35 and the rotation direction of the cooling liquid S are the same as each other.

According to the metal powder production apparatus 1 provided with such a cylindrical body 3, a metal powder R in which an unintended change in the property is small and also sufficient spheroidization is achieved can be produced.

Further, by setting the angle θ1 formed by the axial line A1 of the upper part 31 and the vertical line VL within the above range, a relatively long flying distance of the droplet Q1 can be ensured. This means that when the angle θ1 formed by the axial line A1 and the vertical line VL is within the above range, the upper part 31 is disposed in a state where the axial line A1 is close to parallel to the vertical direction. In such a state, the flying direction due to the free fall of the droplet Q1 is substantially parallel to the axial line A1, and therefore, a sufficient flying distance along the up-and-down direction of the cylindrical body 3 can be ensured. In other words, on the inner circumferential surface 34 of the upper part 31, the cooling liquid layer S1 is formed, and therefore, the flying distance in the horizontal direction is decreased by that amount. On the other hand, in the up-and-down direction of the cylindrical body 3, the shape which is long and thin in the vertical direction can be utilized to the maximum, and therefore, a sufficient flying distance is ensured. As a result, the droplet Q1 flies a sufficiently long flying distance, and thus, a sufficiently long flying time is ensured. Due to this, during flying, spheroidization of the droplet Q1 by surface tension sufficiently proceeds, and a metal powder R in which sufficient spheroidization is achieved is finally obtained.

The angle θ1 formed by the axial line A1 and the vertical line VL is set to 0° or more and 20° or less, but is preferably set to 0° or more and 10° or less. When the angle θ1 formed by the axial line A1 and the vertical line VL exceeds the above upper limit, the axial line A1 is in a state of being relatively largely inclined with respect to the vertical line VL. Due to this, when considering the way of spreading of the molten metal Q at the time of colliding with the gas G and scattering, there is a fear that the possibility that many of the droplets Q1 go into the cooling liquid layer S1 formed on the side surface in the inner wall of the upper part 31 increases. As a result, a sufficiently long flying distance cannot be ensured, and spheroidization of the droplets Q1 becomes insufficient, and therefore, there is a fear that spheroidization of a metal powder R to be finally obtained becomes insufficient.

In the example shown in FIG. 6, the rotation direction R1 of the groove 35 is a counterclockwise direction (left-handed direction).

Figure 7:
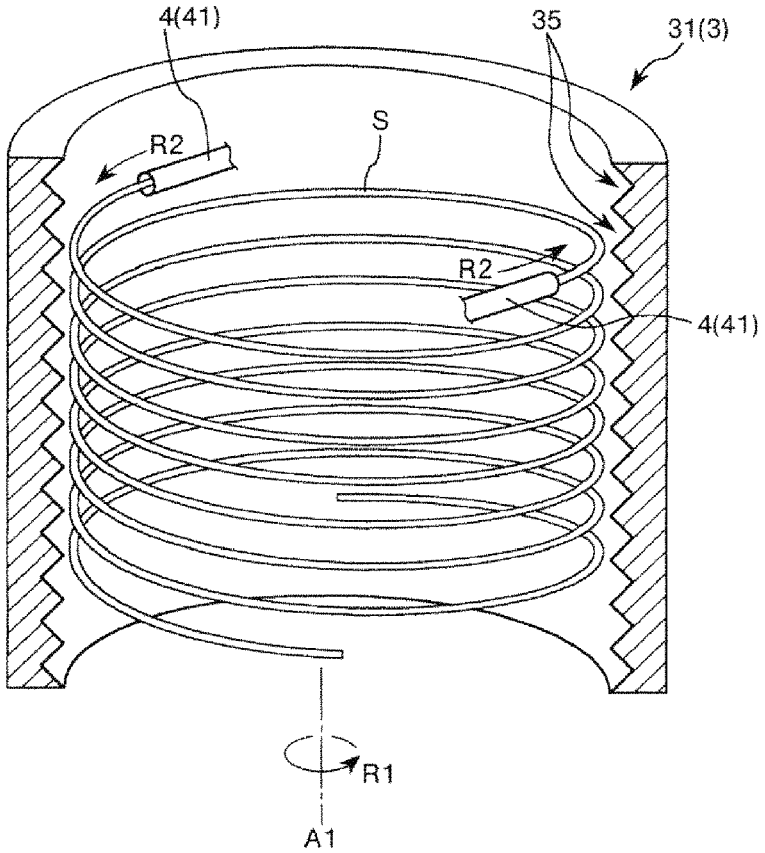
FIG. 7 is a view in which the flow of a cooling liquid is schematically added to the cylindrical body shown in FIG. 6.

On the other hand, FIG. 7 is a view in which the flow of the cooling liquid S is schematically added to the cylindrical body 3 shown in FIG. 6. In the example shown in FIG. 7, the rotation direction R2 of the cooling liquid S is also a counterclockwise direction (left-handed direction).

By configuring the groove 35 and the cooling liquid outflow section 4 such that the rotation direction of the groove 35 and the rotation direction of the cooling liquid S are the same as each other in this manner, turbulence hardly occurs in the cooling liquid S flowing on the inner circumferential surface 34 of the upper part 31. Due to this, the cooling liquid S can smoothly flow on the inner circumferential surface 34, and the cooling liquid layer S1 to be formed can be further stabilized. Such a phenomenon is considered to occur because the rotation direction of the groove 35 and the rotation direction of the cooling liquid S are the same as each other, and therefore, the cooling liquid S easily flows along the groove 35, and thus, the cooling liquid layer S1 easily ensures a sufficient thickness, and so on.

Further, by providing the groove 35, the inner surface thereof can impart a drag to the cooling liquid S to fall due to gravity. In other words, the cooling liquid layer S1 behaves as if it is caught on the groove 35, and therefore, the falling speed by gravity is relaxed. Due to this, the falling speed is decreased, and thus, also from this point of view, a sufficient thickness can be imparted to the cooling liquid layer S1.

As a result, a stable cooling action is exhibited by the cooling liquid layer S1, and therefore, the variation in the property of the metal powder R to be produced can be suppressed. For example, the variation in the composition such as oxidation amount (oxygen content) or crystallinity and the spread of the particle size distribution can be minimized, and thus, the quality and fluidity of the metal powder R can be increased.

Further, the groove 35 and the cooling liquid outflow section 4 are configured such that when a plane orthogonal to the axial line A1 is assumed, an angle formed by this plane and the groove 35 and an angle formed by the plane and the outflow direction of the cooling liquid S may be different from each other, but are preferably the same as each other. According to this, the groove 35 and the flow of the cooling liquid S match each other, and thus, the occurrence of turbulence in the cooling liquid S can be minimized. As a result, the cooling liquid layer S1 can be further stabilized.

The condition that "an angle formed by the plane and the groove 35 and an angle formed by the plane and the outflow direction of the cooling liquid S are the same as each other" includes a state where a difference between these angles is 10° or less.

Further, the difference between these angles may exceed 10°, however, even in such a case, if the difference between these angles is 30° or less, a certain level of stabilization of the cooling liquid layer S1 can be expected.

The angle formed by the plane and the groove 35 is not necessarily constant in the entire groove 35, and may be partially different. For example, it may be configured such that the angle formed by the plane and the groove 35 gradually increases in the vertically downward direction, or on the contrary, it may be configured such that the angle formed by the plane and the groove 35 gradually decreases in the vertically downward direction.

The width of the groove 35 is appropriately set according to the inner diameter of the upper part 31, the outflow speed of the cooling liquid S, or the like, but is preferably 0.01% or more and 1% or less, more preferably 0.05% or more and 0.5% or less of the inner diameter of the upper part 31. According to this, the width of the groove 35 is optimized according to the circumferential speed of the cooling liquid layer S1 formed on the upper part 31. As a result, the cooling liquid layer S1 can be particularly stabilized.

When the width of the groove 35 is less than the above lower limit, in the case where the inner diameter of the upper part 31 is small, the circumferential speed of the cooling liquid layer S1 is also small, and therefore, there is a fear that the width of the groove 35 is too narrow, and the effect of the groove 35 is exclusive. On the other hand, when the width of the groove 35 exceeds the above upper limit, in the case where the inner diameter of the upper part 31 is small, there is a fear that the angle formed by the plane and the groove 35 has to be increased to some extent.

The width of the groove 35 is preferably about 0.1 mm or more and 20 mm or less, more preferably about 0.5 mm or more and 10 mm or less.

The width of the groove 35 is not necessarily constant in the entire groove 35, and may be partially different.

Figure 8:
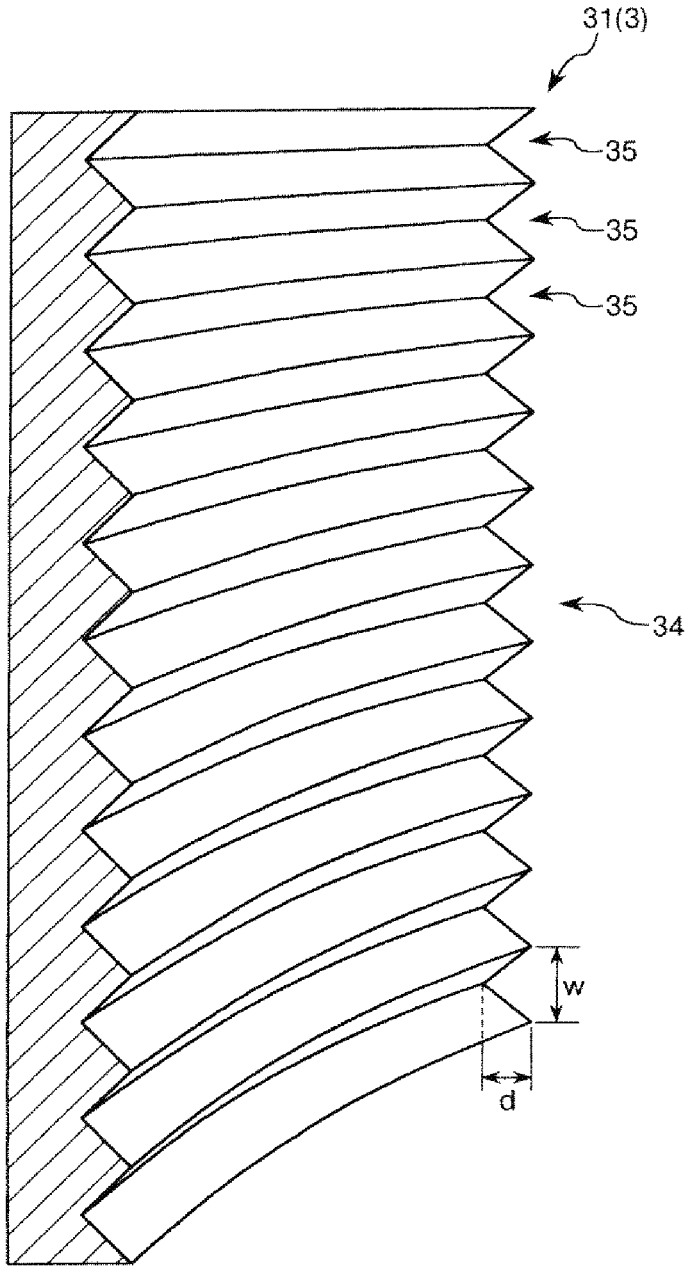
FIG. 8 is a further enlarged partial cross-sectional view of the portion shown in FIG. 6.

FIG. 8 is a further enlarged partial cross-sectional view of the portion shown in FIG. 6.

The "width of the groove 35" refers to the length W in a direction orthogonal to the extending direction of the groove 35 as shown in FIG. 8.

On the other hand, also the depth of the groove 35 is appropriately set according to the inner diameter of the upper part 31, the outflow speed of the cooling liquid S, or the like, but is preferably 10% or more and 500% or less, more preferably 20% or more and 300% or less of the width of the groove 35. According to this, the depth of the groove 35 is optimized according to the circumferential speed of the cooling liquid layer S1 formed on the upper part 31. As a result, the cooling liquid layer S1 can be particularly stabilized.

When the depth of the groove 35 is less than the above lower limit, in the case where the inner diameter of the upper part 31 is small, the circumferential speed of the cooling liquid layer S1 is also small, and therefore, there is a fear that the depth of the groove 35 is too shallow, and the effect of the groove 35 is exclusive. On the other hand, when the depth of the groove 35 exceeds the above upper limit, it becomes difficult to replace the cooling liquid S particularly in the bottom part of the groove 35, and therefore, there is a fear that the cooling speed of part of the metal powder R is decreased.

The depth of the groove 35 is not necessarily constant in the entire groove 35, and may be partially different.

The "depth of the groove 35" refers to the maximum depth d of the groove 35 as shown in FIG. 8.

The transverse cross-sectional shape of the groove 35 is not particularly limited, and may be an irregular shape, however, examples of the shape include semicircles such as a part of a perfect circle, a part of an ellipse, and a part of an elongated circle, and polygons such as a triangle and a quadrangle. Among these, when the shape is a semicircle or a triangle, the ease of replacement of the cooling liquid S in the groove 35 can be increased. Therefore, the uniformity of the quality of the metal powder R can be further increased. Incidentally, the polygon includes shapes in which the corners thereof are rounded off.

Figure 9:
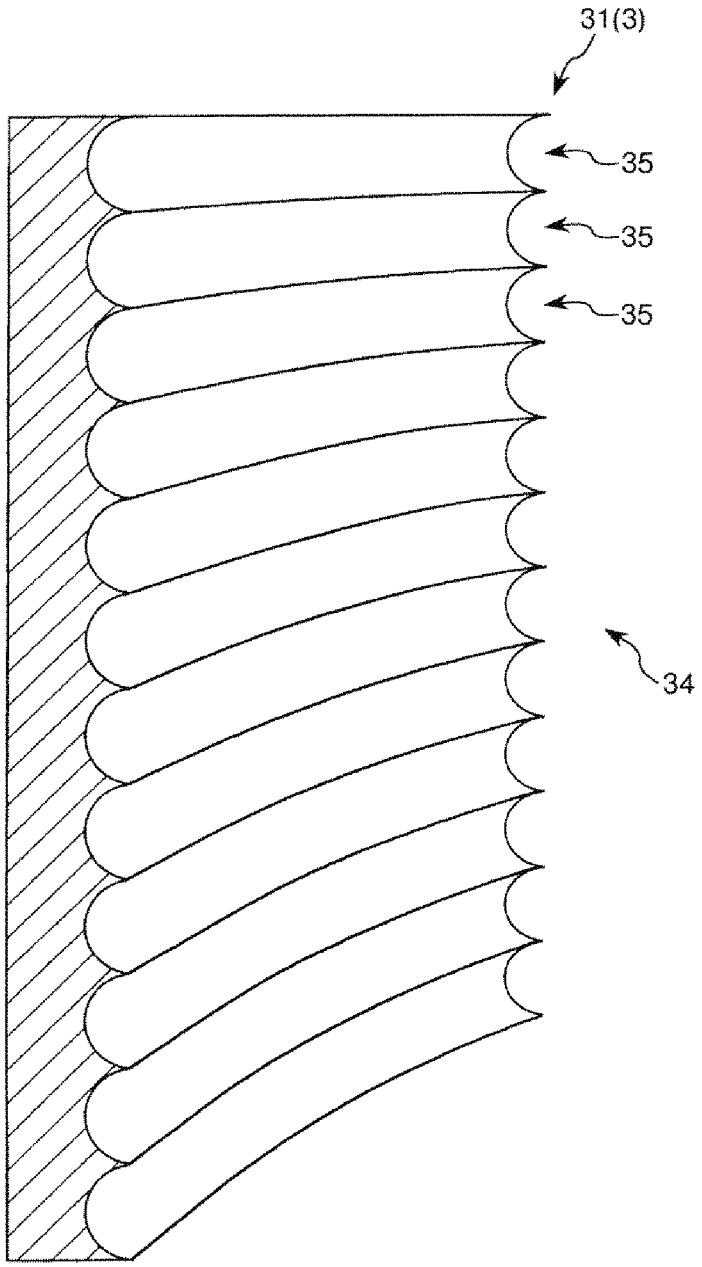
FIG. 9 is a partial cross-sectional view showing a modification of the groove shown in FIG. 8.
Figure 10:
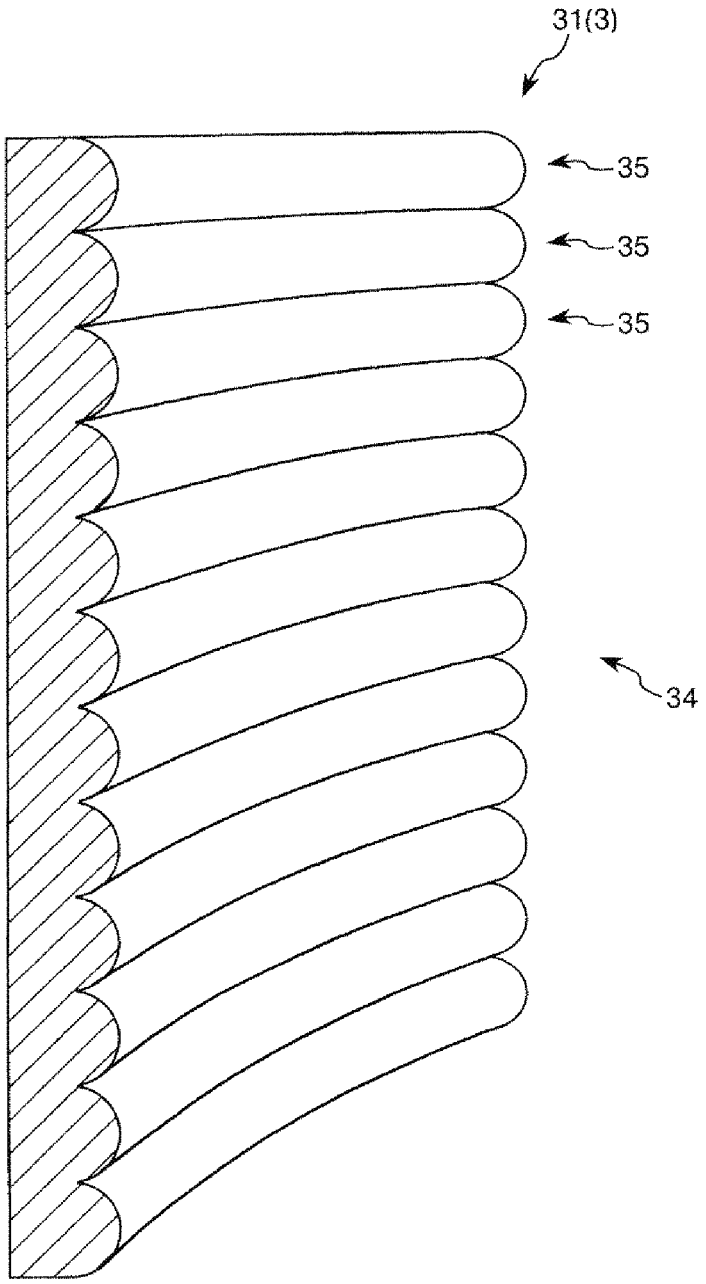
FIG. 10 is a partial cross-sectional view showing a modification of the groove shown in FIG. 8.

FIGS. 9 and 10 are each a partial cross-sectional view showing a modification of the groove 35 shown in FIG. 8.

The transverse cross-sectional shape of the groove 35 shown in FIG. 9 is a semicircle.

On the other hand, the transverse cross-sectional shape of the groove 35 shown in FIG. 10 is a shape similar to a triangle. More specifically, the transverse cross-sectional shape of the groove 35 shown in FIG. 10 is a triangle in which two sides among the three sides are arcs curved so as to be recessed inside.

Even in the case of the groove 35 having such a shape, the effect as described above is exhibited.

The transverse cross-sectional shape of the groove 35 is not necessarily constant in the entire groove 35, and may be partially different.

On the other hand, the axial line A2 of the lower part 32 according to this embodiment is more largely inclined with respect to the vertical direction than the axial line A1 of the upper part 31. That is, the angle θ2 formed by the axial line A2 of the lower part 32 and the vertical line VL is larger than the angle θ1 formed by the axial line A1 of the upper part 31 and the vertical line VL. Incidentally, in the following description, the angle formed by the axial line A2 and the vertical line VL is also referred to as "the inclination angle of the axial line A2".

By setting the angle θ2 formed by the axial line A2 of the lower part 32 and the vertical line VL to be larger than the angle θ1 formed by the axial line A1 of the upper part 31 and the vertical line VL, the axial line becomes discontinuous in the connection part 33 between the upper part 31 and the lower part 32. Therefore, the flowing-down speed of the cooling liquid S decreases in the connection part 33 between the upper part 31 and the lower part 32 after the cooling liquid S supplied to the upper part 31 flows down along the inner circumferential surface 34 of the upper part 31. As a result, the cooling liquid S continues to be in a state of being retained in the connection part 33 between the upper part 31 and the lower part 32. Due to this, in the internal space 30 of the cylindrical body 3, the cooling liquid layer S1 having a sufficient thickness is formed also on the bottom surface as well as on the side surface. Therefore, the droplet Q1 scattering in the internal space 30 can go into the cooling liquid S having a sufficient volume with a high probability and is cooled uniformly in a short time, and thus, an unintended change in the composition or structure of the droplet Q1 is suppressed. That is, for example, the variation in the composition such as oxidation amount (oxygen content) or crystallinity can be minimized.

Incidentally, the angle θ1 refers to an angle on the acute angle side of the angles formed by the axial line A1 and the vertical line VL. Similarly, the angle θ2 refers to an angle on the acute angle side of the angles formed by the axial line A2 and the vertical line VL.

On the other hand, in the case where the angle θ2 is smaller than the angle θ1, the axial line A2 of the lower part 32 is in a state closer to parallel to the vertical direction. Due to this, the cooling liquid S is in a state of particularly easily flowing down, and therefore, the cooling liquid S is hardly retained in the connection part 33 between the upper part 31 and the lower part 32. As a result, the cooling liquid layer S1 having a sufficient thickness cannot be formed on the bottom surface of the upper part 31, and therefore, the cooling speed decreases or the droplet Q1 is not sufficiently cooled, and therefore, there is a fear that an unintended change in the composition occurs in the droplet Q1.

The inclination angle of the axial line A2 is not particularly limited, and may be set to be the same as the inclination angle of the axial line A1. More specifically, in the case where the inclination angle of the axial line A2 and the inclination angle of the axial line A1 are the same, the upper part 31 and the lower part 32 shown in FIG. 4 are continuous with each other in the vertical direction along the common axis, however, even in such a case, the effect brought about by providing the groove 35 is obtained.

Further, the difference between the angle θ2 and the angle θ1 is not particularly limited as long as the angle θ2 is larger than the angle θ1. However, the difference between the angle θ2 and the angle θ1 is preferably 5° or more and 90° or less, more preferably 20° or more and 90° or less, further more preferably 45° or more and 90° or less, particularly preferably 60° or more and 90° or less. When the difference between the angle θ2 and the angle θ1 is within the above range, even if the inner diameter of the upper part 31 or the lower part 32 is relatively large, the cooling liquid S is more easily retained in the connection part 33 between the upper part 31 and the lower part 32, and the cooling liquid layer S1 having a sufficient thickness can be more reliably formed on the bottom surface of the internal space of the upper part 31. Due to this, the droplet Q1 scattering in the internal space 30 is cooled uniformly in a shorter time, and thus, an unintended change in the composition of the droplet Q1 is more reliably suppressed.

The inner diameter of the lower part 32 may be larger than or equal to the inner diameter of the upper part 31, but is preferably smaller than the inner diameter of the upper part 31. According to this, the maximum flow amount of the cooling liquid S in the lower part 32 is smaller than the maximum flow amount of the cooling liquid S in the upper part 31, and the cooling liquid S is easily accumulated in the connection part 33 between the upper part 31 and the lower part 32. Due to this, in the internal space 30 of the cylindrical body 3, the cooling liquid layer S1 having a more sufficient thickness is formed on the bottom surface. As a result, the droplet Q1 scattering in the internal space 30 is cooled uniformly in a shorter time, and thus, an unintended change in the composition of the droplet Q1 is more reliably suppressed.

When the inner diameter of the lower part 32 is too small, the maximum flow amount of the cooling liquid S in the lower part 32, that is, the discharge ability is too small this time, and therefore, there is a fear that the cooling liquid S is retained excessively inside the upper part 31. Therefore, the inner diameter of the lower part 32 is preferably within the predetermined range of the ratio although it is smaller than the inner diameter of the upper part 31. More specifically, the inner diameter d2 of the lower part 32 is preferably 0.1 times or more and 0.9 times or less, more preferably 0.2 times or more and 0.8 times or less, further more preferably 0.3 times or more and 0.7 times or less of the inner diameter d1 of the upper part 31. According to this, the internal space 30 becomes a space having a necessary and sufficient size for the droplet Q1 to fly while spheroidizing the droplet Q1.

Further, the lower part 32 may include a space filled with air or the gas G, but preferably filled with the cooling liquid S. According to this, after the droplet Q1 goes into the cooling liquid layer S1, a state where the droplet Q1 continues to be in contact with the cooling liquid S can be more reliably created. As a result, the droplet Q1 can continue to be cooled over a longer period of time, and therefore, the occurrence of an unintended change in the composition in the droplet Q1 can be suppressed.

Further, in the inside of the upper part 31 shown in FIG. 4, the cooling liquid layer S1 is formed on each of the side surface (lateral side) and the bottom surface (lower side). That is, when the cooling liquid S is retained in the connection part 33 between the upper part 31 and the lower part 32, the inside of the upper part 31, that is, the internal space 30 becomes a space surrounded by the cooling liquid layer S1 except for the upper side. It can be said that such a space is a space which is hermetically sealed except for the upper side.

On the other hand, from the upper side of the internal space 30, the gas G (fluid) continues to be jetted. Due to this, a gas never penetrates from the lateral side or the lower side of the internal space 30, and in the internal space 30, the flow of the gas is always formed in the vertically downward direction. Then, the gas G jetted is caught in the cooling liquid S and discharged to the lower part 32 side, and therefore, a state where the internal space 30 is filled with the gas G is favorably maintained. As a result, for example, even if the droplet Q1 at a very high temperature comes into contact with the cooling liquid S and the cooling liquid S is evaporated to generate a vapor (for example, water vapor or the like), the vapor can be prevented from going up. Therefore, the decrease in the cooling speed due to the contact between the droplet Q1 and the vapor for a long time, or the inhibition of the droplet Q1 from falling due to the occurrence of an updraft can be suppressed.

In particular, when the angle θ1 exceeds the above upper limit (the axial line A1 is inclined with respect to the vertical line VL at an angle exceeding the above upper limit), the flowing-down speed of the cooling liquid S in the upper part 31 decreases, and therefore, there is a fear that the discharge speed of the gas in the internal space 30 to the lower part 32 side decreases. In this case, oxygen, vapor, or the like is likely to be retained in the internal space 30, and therefore, there is a fear that an unintended change in the composition such as oxidation of a metal occurs.

Incidentally, in FIG. 4, a configuration in which the lower part 32 is connected to a side wall of the upper part having a cylindrical shape is shown, however, the configuration of the cylindrical body 3 is not limited thereto, and for example, a configuration in which the lower part 32 is connected to the bottom part of the upper part 31 may be adopted.

Further, also the configuration of the fluid jet ports 53 is not limited to the configuration shown in FIG. 2.

On the downstream side of the lower part 32, that is, on the opposite side to the upper part 31, a discharge pipe (not shown) for discharging the metal powder R along with the cooling liquid S may be connected. This discharge pipe is connected to the collection tank (not shown).

Then, a mixture of the metal powder R and the cooling liquid S collected in the collection tank is subjected to a liquid removal device or the like, whereby the metal powder R can be separated. The separated metal powder R is dried by a dryer or the like.

According to the metal powder production apparatus 1 as described above, a metal powder R in which an unintended change in the property is small and also sufficient spheroidization is achieved can be obtained.

Hereinabove, the metal powder production apparatus according to the invention has been described based on preferred embodiments shown in the drawings, however, the invention is not limited thereto.

For example, in the metal powder production apparatus according to the invention, the configuration of each part according to the above-mentioned first and second embodiments can be replaced with an arbitrary configuration exhibiting a similar function, and also an arbitrary configuration can be added.

EXAMPLES

Next, specific examples of the invention will be described.

1. Production of Metal Powder

Example 1A (1) First, the metal powder production apparatus shown in FIG. 1 was prepared. The configuration of the metal powder production apparatus is as shown in Table 1. Further, as the fluid to be jetted from the fluid jet section, nitrogen gas was used, and as the cooling liquid to be allowed to flow out from the cooling liquid outflow section, tap water was used. Then, the flow rate was adjusted so that a space was always formed in the cylindrical body. Further, in the vicinity of the connection part to the upper part in the lower part of the cylindrical body, the inner diameter was set to be gradually changed.

(2) Subsequently, as the raw material, an ingot of SUS 304L was put into the molten metal supply section and melted therein, whereby a molten metal was prepared.

(3) Subsequently, by operating the metal powder production apparatus, a metal powder was produced. Incidentally, during the production of the metal powder, the inside of the cylindrical body was in a state of being surrounded by the cooling liquid layer on the lateral side and the lower side.

Examples 2a to 12A

Metal powders were obtained in the same manner as in Example 1A except that the configuration of the metal powder production apparatus was changed as shown in Table 1, respectively.

Comparative Examples 1A to 10A

Metal powders were obtained in the same manner as in Example 1A except that the configuration of the metal powder production apparatus was changed as shown in Table 1, respectively.

2. Evaluation of Metal Powder 2.1 Evaluation of Sphericity

Each of the metal powders produced in Examples 1A to 12A and Comparative Examples 1A to 10A was subjected to a classification treatment.

Subsequently, with respect to each classified metal powder, a particle size distribution on a mass basis was obtained using a laser diffraction particle size distribution analyzer. Then, a particle diameter at an accumulation of 50% from a small particle diameter side in the particle size distribution was determined as the average particle diameter. As a result, the average particle diameter of each of the metal powders produced in the respective Examples and the respective Comparative Examples fell within the range of 7.5 to 8.5 μm.

Subsequently, with respect to each classified metal powder, a tap density was measured. The tap density of the metal powder was measured by a method in accordance with Metallic powders—Determination of tap density defined in JIS Z 2512 (2012). Further, the tap density is related to the sphericity of the particles of the metal powder and the particle size distribution of the metal powder, and therefore, the sphericity and the particle size distribution can be indirectly evaluated by evaluating the tap density.

The measured tap density is shown in Table 1.

2.2 Evaluation of Fluidity

With respect to each of the metal powders produced in Examples 1A to 12A and Comparative Examples 1A to 10A, the fluidity (sec) was measured by the test method for the fluidity of a metal powder defined in JIS Z 2502:2012.

2.3 Evaluation of Production Yield (Yield Rate)

Each of the metal powders produced in Examples 1A to 12A and Comparative Examples 1A to 10A was observed using a scanning electron microscope at a magnification of 500 times.

Subsequently, images were captured in 5 fields of view, and in each of the obtained images, a spherical particle and a particle other than a spherical particle (irregular-shaped particle) were specified, respectively.

Then, the number of spherical particles and the number of irregular-shaped particles were counted, and thereafter, the yield rate was calculated according to the following formula.

Yield rate (%)=the number of spherical particles/(the number of spherical particles+the number of irregular-shaped particles)×100

The spherical particle and the irregular-shaped particle are classified based on the circularity calculated according to the following formula from the perimeter of the particle image specified in the captured image and the perimeter of a perfect circle having the same area as that of the particle image.

Circularity=(the perimeter of a perfect circle having the same area as that of the particle image)/(the perimeter of the particle image)

Specifically, a particle having a circularity of 0.9 or more is defined as "spherical particle", and a particle having a circularity of less than 0.9 is defined as "irregular-shaped particle".

produced in the respective Examples, the sphericity of each particle is high, and therefore, the tap density and the fluidity are increased.

Further, although not shown in Table 1, it was confirmed that each of the metal powders produced in the respective Examples has a lower oxygen concentration than the metal powders produced by a production method in the related art such as a remelting process.

Therefore, it was confirmed that according to the invention, a metal powder in which an unintended change in the property is small and also sufficient spheroidization is achieved can be produced.

Further, metal powders were produced in the same manner as in Examples 1A to 12A and Comparative Examples 1A to 10A except that the gas to be jetted from the fluid jet section was changed to argon gas, however, the evaluation results showed the same tendencies as described above.

TABLE 1

| | Configuration of metal powder production apparatus | | | | | Evaluation results of metal powder | | |
|---|---|---|---|---|---|---|---|---|
| | Angle formed by axial line A1 of upper part and vertical line ° | Angle formed by axial line A2 of lower part and vertical line ° | Minimum inner diameter d2 of lower part (relative ratio to inner diameter d1) % | Length L1 of upper part (relative ratio to inner diameter d1) times | Length L2 of lower part (relative ratio to inner diameter d1) times | Tap density g/cm$^3$ | Fluidity sec | Yield rate % |
| Example 1A | 0 | 0 | 80 | 7 | 10 | 4.1 | 19.24 | 87.2 |
| Example 2A | 0 | 0 | 70 | 5 | 3 | 4.4 | 17.25 | 89.4 |
| Example 3A | 0 | 0 | 50 | 2 | 2.5 | 4.5 | 16.48 | 90.6 |
| Example 4A | 0 | 5 | 40 | 3.5 | 2.5 | 4.7 | 16.95 | 92.5 |
| Example 5A | 0 | 0 | 30 | 2 | 2 | 4.9 | 17.44 | 93.4 |
| Example 6A | 0 | 5 | 20 | 1.5 | 2.5 | 4.8 | 17.56 | 92.1 |
| Example 7A | 7.5 | 7.5 | 35 | 2.5 | 3 | 4.7 | 18.25 | 91.3 |
| Example 8A | 7.5 | 5 | 50 | 3.5 | 4 | 4.4 | 17.36 | 89.4 |
| Example 9A | 7.5 | 2.5 | 75 | 5 | 5 | 4.2 | 18.54 | 88.1 |
| Example 10A | 15 | 10 | 35 | 2.5 | 3 | 4.6 | 18.75 | 90.5 |
| Example 11A | 15 | 5 | 50 | 3.5 | 4 | 4.3 | 17.86 | 88.8 |
| Example 12A | 15 | 5 | 75 | 5 | 7 | 4.1 | 18.96 | 87.6 |
| Comp. Ex. 1A | 0 | 0 | 10 | 1 | 1 | — | — | — |
| Comp. Ex. 2A | 0 | 0 | 100 | 3 | 2.5 | 4.0 | 26.9 | 65.4 |
| Comp. Ex. 3A | 7.5 | 7.5 | 10 | 1 | 1 | — | — | — |
| Comp. Ex. 4A | 7.5 | 7.5 | 100 | 3 | 2.5 | 3.9 | 27.2 | 64.5 |
| Comp. Ex. 5A | 15 | 15 | 10 | 1 | 1 | — | — | — |
| Comp. Ex. 6A | 15 | 15 | 100 | 3 | 2.5 | 3.8 | 27.5 | 63.2 |
| Comp. Ex. 7A | 30 | 0 | 50 | 2 | 3 | 3.9 | 29.4 | 69.7 |
| Comp. Ex. 8A | 30 | 0 | 30 | 2 | 2 | 3.8 | 28.6 | 68.6 |
| Comp. Ex. 9A | 30 | 30 | 50 | 2 | 3 | 3.6 | 30.2 | 58.6 |
| Comp. Ex. 10A | 30 | 30 | 30 | 2 | 2 | 3.7 | 30.6 | 56.9 |

As apparent from Table 1, it was confirmed that each of the metal powders produced in Examples 1A to 12A has a higher tap density as compared with the metal powders produced in Comparative Examples 1A to 10A. This indicates that the sphericity of the particles of the metal powder is high and the particle size distribution of the metal powder is wide to some extent.

In addition, it was confirmed that by optimizing the minimum inner diameter d2 of the lower part, also the fluidity can be increased (the time required for flow can be shortened). Further, when attention was paid to the shape of each particle, it was confirmed that the ratio of particles having high sphericity (yield rate) is high in the metal powders produced in the respective Examples. Based on these results, it can be said that in the metal powders 3. Production of Metal Powder Example 1B (1) The metal powder production apparatus shown in FIG. 4 was prepared. The configuration of the metal powder production apparatus is as shown in Table 2, and as the cylindrical body, a cylindrical body in which a groove having a triangle transverse cross-sectional shape was formed on the inner circumferential surface was used. Further, as the fluid to be jetted from the fluid jet section, nitrogen gas was used, and as the cooling liquid to be allowed to flow out from the cooling liquid outflow section, tap water was used. Then, the flow rate was adjusted so that a space can always be formed in the cylindrical body.

(2) Subsequently, as the raw material, an ingot of SUS 316L was put into the molten metal supply section and melted therein, whereby a molten metal was prepared.

(3) Subsequently, by operating the metal powder production apparatus, a metal powder was produced. Incidentally, during the production of the metal powder, the inside of the lower part of the cylindrical body was maintained in a state of being filled with the cooling liquid containing the metal powder. That is, the inside of the upper part of the cylindrical body was in a state of being surrounded by the cooling liquid layer on the lateral side and the lower side.

Examples 2B to 14B

Metal powders were obtained in the same manner as in Example 1B except that the configuration of the metal powder production apparatus was changed as shown in Table 2, respectively.

Comparative Examples 1B and 2B

Metal powders were obtained in the same manner as in Example 1B except that the configuration of the metal powder production apparatus was changed as shown in Table 2, respectively. Incidentally, in Comparative Examples 1B and 2B, the inclination angle θ1 of the upper part of the cylindrical body did not satisfy the predetermined conditions.

Comparative Examples 3B to 6B

Metal powders were obtained in the same manner as in Example 1B except that the configuration of the metal powder production apparatus was changed as shown in Table 2, respectively. Incidentally, in Comparative Examples 3B to 6B, a cylindrical body in which a groove was not formed was used.

4. Evaluation of Metal Powder

With respect to the metal powders produced in Examples 1B to 14B and Comparative Examples 1B to 6B, evaluation was performed using the same evaluation methods as the above-mentioned evaluation methods performed for the metal powders produced in Examples 1A to 12A and Comparative Examples 1A to 10A (2.1 Evaluation of Sphericity, 2.2 Evaluation of Fluidity, and 2.3 Evaluation of Production Yield (Yield Rate)). The evaluation results are shown in Table 2.

TABLE 2

| | Configuration of metal powder production apparatus | | | | | | Evaluation results of metal powder | | |
|---|---|---|---|---|---|---|---|---|---|
| | Groove | | | Inclination angle | Relationship between upper part and lower part | | | | |
| | Transverse cross-sectional shape — | Width of groove/ inner diameter of upper part % | Depth of groove/width of groove % | θ1 of upper part of cylindrical body ° | Inner diameter ratio d2/d1 — | Difference in inclination angle θ2-θ1 ° | Tap density g/cm$^3$ | Fluidity sec | Yield rate % |
| Example 1B | triangle | 0.03 | 450 | 0 | 0.1 | 60 | 5.14 | 18.24 | 93 |
| Example 2B | triangle | 0.15 | 380 | 0 | 0.3 | 75 | 5.25 | 18.05 | 95 |
| Example 3B | triangle | 0.31 | 250 | 0 | 0.5 | 80 | 5.46 | 17.92 | 96 |
| Example 4B | triangle | 0.45 | 180 | 0 | 0.7 | 85 | 5.28 | 18.03 | 95 |
| Example 5B | triangle | 0.84 | 60 | 0 | 0.9 | 90 | 5.36 | 18.78 | 91 |
| Example 6B | triangle | 0.06 | 420 | 5 | 0.2 | 30 | 5.22 | 18.35 | 92 |
| Example 7B | triangle | 0.24 | 320 | 5 | 0.5 | 75 | 5.39 | 18.18 | 94 |
| Example 8B | semicircle | 0.48 | 150 | 5 | 0.8 | 90 | 5.19 | 18.58 | 92 |
| Example 9B | semicircle | 0.05 | 430 | 10 | 0.4 | 45 | 5.32 | 18.25 | 93 |
| Example 10B | triangle | 0.36 | 220 | 10 | 0.6 | 75 | 5.20 | 18.42 | 92 |
| Example 11B | triangle | 0.04 | 440 | 20 | 0.1 | 10 | 4.95 | 19.21 | 91 |
| Example 12B | semicircle | 0.77 | 80 | 20 | 1.0 | 90 | 4.96 | 20.40 | 90 |
| Example 13B | triangle | 0.33 | 240 | 0 | 0.4 | 0 | 4.90 | 21.88 | 88 |
| Example 14B | semicircle | 0.42 | 200 | 0 | 0.5 | 90 | 4.93 | 21.54 | 87 |
| Comp. Ex. 1B | triangle | 0.18 | 310 | 30 | 0.3 | 0 | 4.63 | 29.56 | 58 |
| Comp. Ex. 2B | triangle | 0.31 | 250 | 30 | 0.5 | 90 | 4.69 | 30.85 | 55 |
| Comp. Ex. 3B | — | — | — | 0 | 0.3 | 0 | 5.35 | 25.20 | 70 |
| Comp. Ex. 4B | — | — | — | 5 | 0.5 | 90 | 5.20 | 24.86 | 67 |
| Comp. Ex. 5B | — | — | — | 10 | 0.4 | 0 | 5.02 | 23.80 | 64 |
| Comp. Ex. 6B | — | — | — | 20 | 0.5 | 90 | 4.85 | 28.66 | 61 |

As apparent from Table 2, it was confirmed that each of the metal powders produced in Examples 1B to 14B has favorable tap density and fluidity as compared with the metal powders produced in Comparative Examples 1B to 6B. Further, when attention was paid to the shape of each particle, it was confirmed that the ratio of particles having high sphericity (yield rate) is high in the metal powders produced in Examples 1B to 14B. Based on these results, it can be said that in the metal powders produced in Examples 1B to 14B, the sphericity of each particle is high, and therefore, the tap density and the fluidity are increased.

Further, although not shown in Table 2, it was confirmed that each of the metal powders produced in Examples 1B to 14B has a lower oxygen concentration than the metal powders produced by a production method in the related art such as a remelting process.

Therefore, it was confirmed that according to the invention, a metal powder in which an unintended change in the property is small and also sufficient spheroidization is achieved can be produced.

Further, metal powders were produced in the same manner as in Examples 1B to 14B and Comparative Examples 1B to 6B except that the gas to be jetted from the fluid jet section was changed to argon gas, however, the evaluation results showed the same tendencies as described above.

What is claimed is:

1. A metal powder production apparatus comprising:

a molten metal supply configured to supply a molten metal;

a fluid jet member configured to receive the molten metal from the molten metal supply, a bottom surface of the fluid jet member having a molten metal port and a plurality of fluid jet ports, the plurality of fluid jet ports being arranged relative to one another so as to circularly surround the molten metal port on the bottom surface in a plan view, each of the plurality of fluid jet ports jetting a fluid toward the molten metal exiting from the molten metal port;

a cylindrical body that is provided to face the molten metal port and the plurality of fluid jet ports, the cylindrical body having an upper part and a lower part, the upper part being located closer to the fluid jet member than the lower part; and a cooling liquid outflow member configured to flow a cooling liquid along an inner circumferential surface of the upper part of the cylindrical body, wherein an angle formed by an axial line of the upper part of the cylindrical body and a vertical line is 0° or more and 20° or less, and an angle formed by an axial line of the lower part of the cylindrical body and the vertical line is 0° or more and 20° or less, and a minimum inner diameter of the lower part of the cylindrical body is 15% or more and 85% or less of an inner diameter of the upper part.

2. The metal powder production apparatus according to claim 1, wherein the cylindrical body includes a portion whose inner diameter continues to decrease downward.

3. The metal powder production apparatus according to claim 1, wherein a length of the upper part in the vertical direction is 1 time or more and 7 times or less of the inner diameter of the upper part.

4. The metal powder production apparatus according to claim 1, wherein a length of the lower part in the vertical direction is 2 times or more of the inner diameter of the upper part.

5. The metal powder production apparatus according to claim 1, wherein the upper part of the cylindrical body has a space which is surrounded by a cooling liquid layer constituted by the cooling liquid on a lateral side and a lower side of the space.

6. A metal powder production apparatus comprising:

a molten metal supply configured to supply a molten metal;

a cylindrical body which is placed on a lower side of the molten metal supply and includes a portion in which a spiral groove is formed on an inner circumferential surface of the cylindrical body;

a fluid jet member configured to jet a fluid toward the molten metal supplied from the molten metal supply; and a cooling liquid outflow member configured to flow a cooling liquid along the inner circumferential surface of the cylindrical body, wherein an angle formed by an axial line of the cylindrical body and a vertical line is 0° or more and 20° or less, and the spiral groove and the cooling liquid outflow member are configured such that a rotation direction of an arbitrary object when the object moves by gravity along the spiral groove and a state where the object moves is viewed from a vertically upper side, and a rotation direction of the cooling liquid when a state where the cooling liquid flows along the inner circumferential surface of the cylindrical body is viewed from the vertically upper side are the same as each other.

7. The metal power production apparatus according to claim 6, wherein an angle formed by a plane orthogonal to the axis line of the cylindrical body and the spiral groove is equal to an angle formed by the plane and an outflow direction of the cooling liquid.

8. The metal powder production apparatus according to claim 6, wherein a width of the groove is 0.01% or more and 1% or less of an inner diameter of the cylindrical body.

9. The metal powder production apparatus according to claim 8, wherein a depth of the spiral groove is 10% or more and 500% or less of the width of the spiral groove.

10. The metal powder production apparatus according to claim 6, wherein a transverse cross-sectional shape of the spiral groove is a triangle or a semicircle.

11. The metal powder production apparatus according to claim 6, wherein the cylindrical body includes an upper part and a lower part provided continuous with the upper part, the upper part is located closer to the molten metal supply than the lower part, and the lower part is inclined with respect to the upper part so that an angle formed by an axial line of the lower part and the vertical line is larger than an angle formed by an axial line of the upper part and the vertical line.

12. The metal powder production apparatus according to claim 1, wherein the fluid is an inert gas.

* * * * *